US005578780A

United States Patent [19]

Wachi

[11] Patent Number: 5,578,780

[45] Date of Patent: Nov. 26, 1996

[54] SOUND SYNTHESIS SYSTEM HAVING PITCH ADJUSTING FUNCTION BY CORRECTING LOOP DELAY

[75] Inventor: Masatada Wachi, Hamamatsu, Japan

[73] Assignee: Yamaha Corporation, Japan

[21] Appl. No.: 426,567

[22] Filed: Apr. 21, 1995

[30] Foreign Application Priority Data

Apr. 28, 1994 [JP] Japan ..... 6-111929

[51] Int. Cl.[6] ..... G10H 5/02

[52] U.S. Cl. ..... 84/659; 84/630

[58] Field of Search ..... 84/630, 659, 661

[56] References Cited

U.S. PATENT DOCUMENTS

| | | | |
|---|---|---|---|
| 5,212,334 | 5/1993 | Smith, III | 84/622 |
| 5,241,129 | 8/1993 | Muto et al. | 84/661 X |
| 5,442,130 | 8/1995 | Kitayama et al. | 84/661 |
| 5,461,189 | 10/1995 | Higashi et al. | 84/622 X |

FOREIGN PATENT DOCUMENTS

| | | |
|---|---|---|
| 52-30417 | 3/1977 | Japan . |
| 4-70699 | 3/1992 | Japan . |

OTHER PUBLICATIONS

"Computer Voice Processing" by Takeshi Anjuin, published by Sanho–Shuppan Kabushiki Kaisha, 1980.

*Primary Examiner*—William M. Shoop, Jr.

*Assistant Examiner*—Jeffrey W. Donels

*Attorney, Agent, or Firm*—Graham & James LLP

[57] ABSTRACT

A sound synthesis system, having a pitch adjusting function, comprises a pitch adjusting portion and a loop including a tone-color forming portion and a delay portion. A signal circulating through the loop is delayed using an amount of delay by the delay portion; and then, the tone-color forming portion imparts a tone-color characteristic to the signal delayed so as to produce a sound signal. In the pitch adjusting portion, a pitch of the sound signal is detected; and an initial constant is generated based on a designated pitch and/or a designated tone color. The initial constant represents an initial delay effected by the delay portion. In addition, an amount of correction is created based on a difference between the pitch detected and the designated pitch. Thus, the amount of delay of the delay portion is corrected by using the amount of correction in such a way that the pitch of the sound signal is automatically adjusted to be equal to the designated pitch in real time. Moreover, the delay portion comprises an integer delay portion and a decimal delay portion, wherein the integer delay portion has a first delay time which corresponds to a number of delay stages each representing a unit time of delay, while the decimal delay portion has a second delay time which is smaller than the unit time of delay. By delicately controlling the amount of delay, it is possible to adjust the pitch of the sound with accuracy.

8 Claims, 5 Drawing Sheets

SOUND SYNTHESIS SYSTEM HAVING PITCH ADJUSTING FUNCTION BY CORRECTING LOOP DELAY

BACKGROUND OF THE INVENTION

1. Field of the Invention

The present invention relates to a sound synthesis system, having a pitch adjusting function, which comprises a loop containing a delay portion and which adjusts pitches of sounds to be synthesized.

2. Prior Art

U.S. Pat. No. 5,212,334 discloses an example of the sound synthesis system, using a digital signal processor (i.e., DSP), which simulates a tone-generation mechanism of an acoustic musical instrument so as to synthesize musical tones of the acoustic musical instrument. An example of the sound synthesis system conventionally known will be described with reference to FIGS. 4 and 5 which show a musical tone synthesizer providing a pitch adjusting function. For convenience's sake, the musical tone synthesizer of FIGS. 4 and 5 is configured by circuit elements. However, functions of the musical tone synthesizer can be embodied by programs which are executed by the DSP. Or the musical tone synthesizer can be configured by other electronic circuits which execute algorithms of the programs.

Now, the musical tone synthesizer of FIG. 4 is designed to simulate sounds of wind instruments such as a clarinet. An overall system of the musical tone synthesizer is divided into three sections, i.e., an excitation circuit 110, a junction 120 and a resonance circuit 130. The excitation circuit 110 is provided to simulate operations of a mouthpiece of the wind instrument; the resonance circuit 130 is provided to simulate operations of a resonance pipe of the wind instrument; and the junction 120 is provided to simulate a scattering manner of air-pressure waves at a connection part between the mouthpiece and resonance pipe of the wind instrument.

The excitation circuit 110 comprises a subtracter 111, a filter 112, an adder 114, a non-linear circuit 115, multipliers 116, 117 and an inverter 'INV'. The subtracter 111 receives a feedback signal which is outputted from the resonance circuit 130 and is transmitted thereto through the junction 120; and the subtracter 111 also receives a blowing-pressure signal 'PRES' which corresponds to blowing pressure applied to the mouthpiece of the wind instrument. Based upon the feedback signal and the blowing-pressure signal PRES, the subtracter 111 performs a calculation to produce a signal which corresponds to air pressure imparted to a reed of the wind instrument. Then, the signal produced is supplied to the filter 112 and is also supplied to the multiplier 116 through the inverter INV. The filter 112 is incorporated into the loop in order to avoid an event in which specific frequency of a signal circulating between the excitation circuit 110 and the resonance circuit 130 does not increase remarkably. An output '$P_1$' of the filter 112 is supplied to the adder 114 in which it is added to an embouchure signal 'EMBS'. Result of addition of the adder 114, i.e., a signal '$P_2$', is supplied to the non-linear circuit 115. The embouchure signal EMBS is a signal which corresponds to open/close manners of lips or shaping of lips. The signal P2 outputted from the adder 114 corresponds to pressure imparted to the reed of the wind instrument.

Based upon the signal $P_2$, the non-linear circuit 115 creates a signal 'Y' corresponding to admittance against air flow which occurs at a gap between the reed and mouthpiece. The signal outputted from the subtracter 111 is inverted to a signal '–PA' by the inverter INV. The multiplier 116 performs a multiplication on the signals Y and –PA so as to produce a signal 'FL' which corresponds to velocity of the air flow passing through the gap between the reed and mouthpiece. This signal FL is supplied to the multiplier 117 in which it is multiplied by a multiplier 'G', wherein the multiplier G is determined responsive to a pipe diameter. Result of multiplication performed by the multiplier 117 is a signal corresponding to a variation of air pressure in the resonance pipe at a certain position which is close to the mouthpiece.

The above signal is supplied to the adder 118 in which it is added to the aforementioned feedback signal. An output signal of the adder 118 is supplied to the adder 119 to which the feedback signal is supplied as well. The junction 120 is configured by the adders 118 and 119 as well as cross-line connection between them.

The output signal of the adder 118 is supplied to the resonance circuit 130 in which it is supplied to the delay circuit 121. The delay circuit 121 is provided to simulate a delay (i.e., a delay time 'DL') between a moment, at which an air-pressure wave is produced by the reed, and a moment at which the air-pressure wave reaches a tone hole. Herein, the tone hole is provided to determine pitch of a sound of the wind instrument. Thus, the delay circuit 121 determines pitch of a musical tone synthesized. A delayed output of the delay circuit 121 is used as the aforementioned feedback signal. The feedback signal is inverted by the inverter IV and is then supplied to the filter 122. The filter 122 performs frequency-band restriction on the feedback signal; thereafter, the feedback signal is outputted from the resonance circuit 130 and is then supplied to the junction 120.

In the junction 120, the feedback signal is added to the output signal of the adder 118 by the adder 119. Then, result of addition of the adder 119 is outputted from the junction 120 and is then supplied to the excitation circuit 110 in which it is transmitted to the subtracter 111. As described above, the excitation signal circulates between the excitation circuit and the resonance circuit 130 through the junction 120. Thus, a waveform signal 'WS' is outputted from the delay circuit 121.

According to the above description, pitch of the waveform signal WS is determined by the delay time DL of the delay circuit 121, wherein the waveform signal WS is a signal representing a musical tone synthesized. Actually, however, the pitch of the waveform signal WS is determined by a total amount of delay of the loop consisting of the excitation circuit 110, the junction 120 and the resonance circuit 130. There are provided the filters 112 and 122 in the loop; and in general, a delay time of the filter is changed responsive to its filter coefficient. For this reason, the delay time DL of the delay circuit 121 should be determined under the consideration of the filter coefficients; otherwise, pitch of a musical tone synthesized must be deviated from a desired pitch. However, in order to compute a delay time of the filter based on the filter coefficient, it is necessary to perform complicated computation and/or complicated processing which requires much time. In order to cope with such a problem, the conventional technology provides a pitch adjusting portion, as shown in FIG. 5, which is incorporated into the musical tone synthesizer of FIG. 4.

In FIG. 5, the waveform signal WS is supplied to a band-pass filter 104 which is controlled to extract only a pitch of a musical tone to be produced. In other words, unnecessary waveform components are removed by the band-pass filter 104. Then, the waveform signal WS is supplied to a clipper 103. The clipper 103 shapes the waveform signal WS into a rectangular-wave signal 'SC2', which is then supplied to one input of a phase comparator 102.

An oscillation circuit 101 performs an oscillation to produce a pulse signal 'SC1' based on a signal 'OF' which corresponds to a keycode. The pulse signal SC1 is supplied to another input of the phase comparator 102 in which it is compared with the rectangular-wave signal SC2. The phase comparator 102 produces a phase-difference signal representative of a phase difference between those signals SC1 and SC2. A low-pass filter 105 smoothes the phase-difference signal to produce an error signal which is then supplied to a conversion circuit 107. The conversion circuit 107 converts the error signal into a signal which corresponds to a delay length.

A delay-length signal outputted from the conversion circuit 107 is supplied to an adder 108 in which it is added to an initial delay-length signal 'd1'. Thus, correction to the delay-length signal is performed. The adder 108 outputs a corrected delay-length signal 'DL'. This corrected delay-length signal DL is supplied to the delay circuit 121. When the pitch of the waveform signal WS coincides with the keycode, the error signal of the low-pass filter 105 is set at zero. When a synchronization detecting circuit 106, which monitors the error signal, detects an event in which the error signal is set at zero, the synchronization detecting circuit 106 outputs an pitch-adjustment end signal 'END' which declares that an adjustment to the pitch is ended.

As described above, phase comparison is performed between a certain reference signal 'SC1', created by the oscillation circuit 101, and the signal 'SC2' corresponding to the waveform signal WS to be controlled; and then, the pitch adjusting portion of FIG. 5 controls the loop by adjusting the delay time 'DL'0 of the delay circuit 121 in such a way that the phase difference between them is eliminated. Thus, the pitch adjusting portion of FIG. 5 is designed based on a so-called PLL system (wherein 'PLL' is an abbreviation for 'Phase Locked Loop'). However, the pitch adjusting portion based on the PLL system is disadvantageous in that much time is required to perform a pitch adjustment; in other words, it is impossible to perform the pitch adjustment on musical tone signals in real time during a progression of musical performance. Due to such disadvantage, pitch adjusting operations should be performed with respect to all pitches of an electronic musical instrument before the musical performance is actually played. Thereafter, results of the pitch adjusting operations are used to obtain data representative of the corrected delay-length signals 'DL'; and then, a table is created using the data. This table is stored by some storage device.In the musical performance actually played, a desired corrected delay-length signal is read from the table in response to a keycode designated, so that the corrected delay-length signal is supplied to the delay circuit 121.

The pitch adjusting portion based on the PLL system has a complicated configuration. In addition, the pitch adjusting portion performs a pitch adjustment based on the phase difference between the reference signal (i.e., SC1) and a musical tone signal created by the musical tone synthesizer which comprises the loop containing the delay circuit. Thus, the conventional technology suffers from a problem that the pitch adjustment is hard to be performed at high speed and with high accuracy.

In addition, a musical tone waveform is a complicated waveform. Therefore, it is difficult to detect a phase of the musical tone waveform. In other words, it is difficult to detect a phase difference between the reference signal and musical tone waveform with accuracy. For this reason, it is impossible to perform a high-precision pitch adjustment with ease.

SUMMARY OF THE INVENTION

It is an object of the present invention to provide a sound synthesis system which is capable of automatically adjusting pitches of sounds (e.g., pitches of musical tones) in real time as well as at high speed and with accuracy.

According to the present invention, a sound synthesis system, having a pitch adjusting function, comprises a pitch adjusting portion and a loop including a tone-color forming portion and a delay portion. A signal circulating through the loop is delayed using an amount of delay by the delay portion; and then, the tone-color forming portion imparts a tone-color characteristic to the signal delayed so as to produce a musical tone signal.

When producing a musical tone, a set of tone color and pitch are designated by a performer. In the pitch adjusting portion, a pitch of the musical tone signal is detected; and an initial constant is generated based on the pitch designated and/or the tone color designated. The initial constant represents an initial delay effected by the delay portion. In addition, an amount of correction is created based on a difference between the pitch detected and the pitch designated. Thus, the amount of delay of the delay portion is corrected by using the amount of correction in such a way that the pitch of the musical tone signal is automatically adjusted to be equal to the pitch designated in real time.

Incidentally, the delay portion comprises an integer delay portion and a decimal delay portion, which provide a delicate control for the amount of delay.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENT

Now, a preferred embodiment of the present invention will be described in detail.

Figure 1:
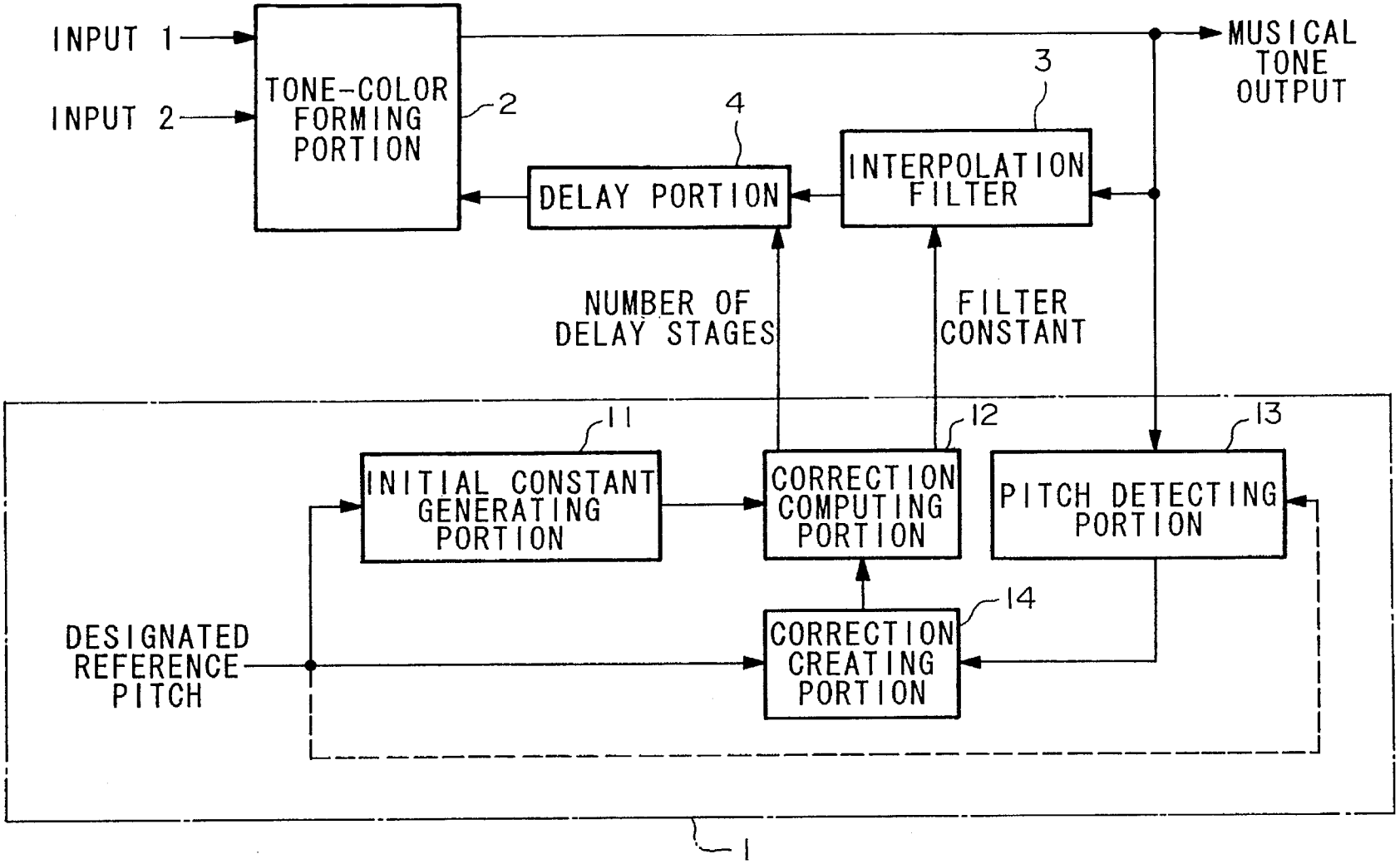
FIG. 1 is a block diagram showing a simplified overall configuration of a sound synthesis system according to an embodiment of the present invention.

FIG. 1 is a block diagram showing a simplified overall configuration of a sound synthesis system having a pitch adjusting function according to the present invention. A pitch adjusting portion 1, corresponding to the pitch adjusting function, is designed to directly detect a pitch of a musical tone signal which is extracted from a loop containing a delay portion. The pitch adjusting portion 1 performs a pitch adjustment based on result of detection of the pitch. A tone-color forming portion 2 forms a tone color of the musical tone signal created by the loop. An interpolation filter 3 imparts a small delay to a signal circulating through the loop. A delay portion 4 contains multiple stages of delay, which almost determine the pitch of the musical tone signal in the loop. The loop is configured by connecting the tone-color forming portion 2, the interpolation filter 3 and the delay portion 4 in a cascade-connection manner.

In the pitch adjusting portion 1, an initial constant generating portion 11 generates pitch data based on a reference pitch designated by a performer, wherein the pitch data approximately represents a pitch of a musical tone to be produced. A correction computing portion 12 computes pitch-correction data by which the pitch of the musical tone signal, extracted from the loop, is corrected. A pitch detecting portion 13 detects the pitch of the musical tone signal extracted from the loop. A correction creating portion 14 creates an amount of correction, based on the designated reference pitch as well as result of detection of the pitch which is detected by the pitch detecting portion 13.

As described above, the pitch adjusting portion 1 is configured by the initial constant generating portion 11, the correction computing portion 12, the pitch detecting portion 13 and the correction creating portion 14.

Figure 4:
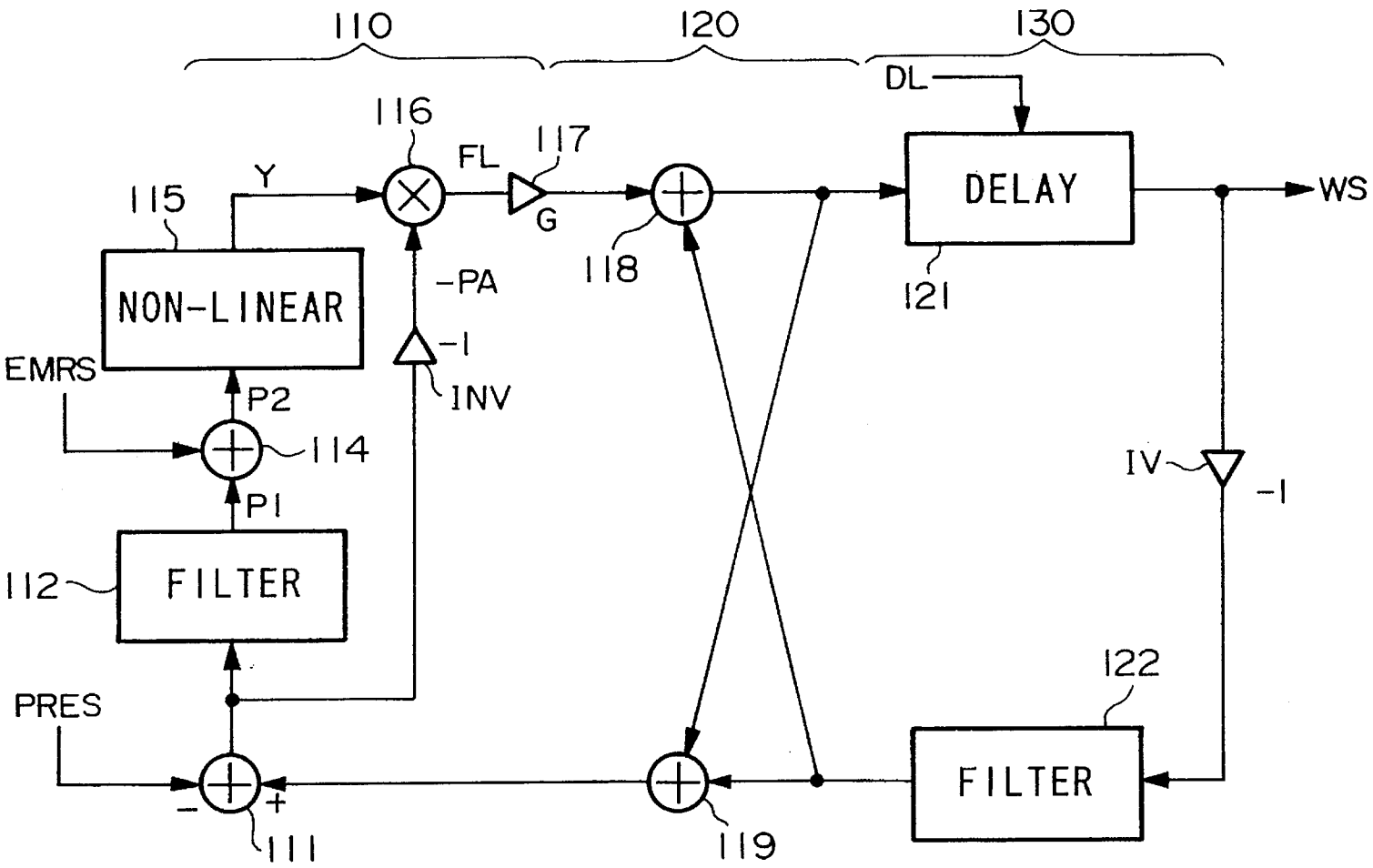
FIG.4 (PRIOR ART)
FIG. 4 is a block diagram showing the sound synthesis system conventionally known.
Figure 5:
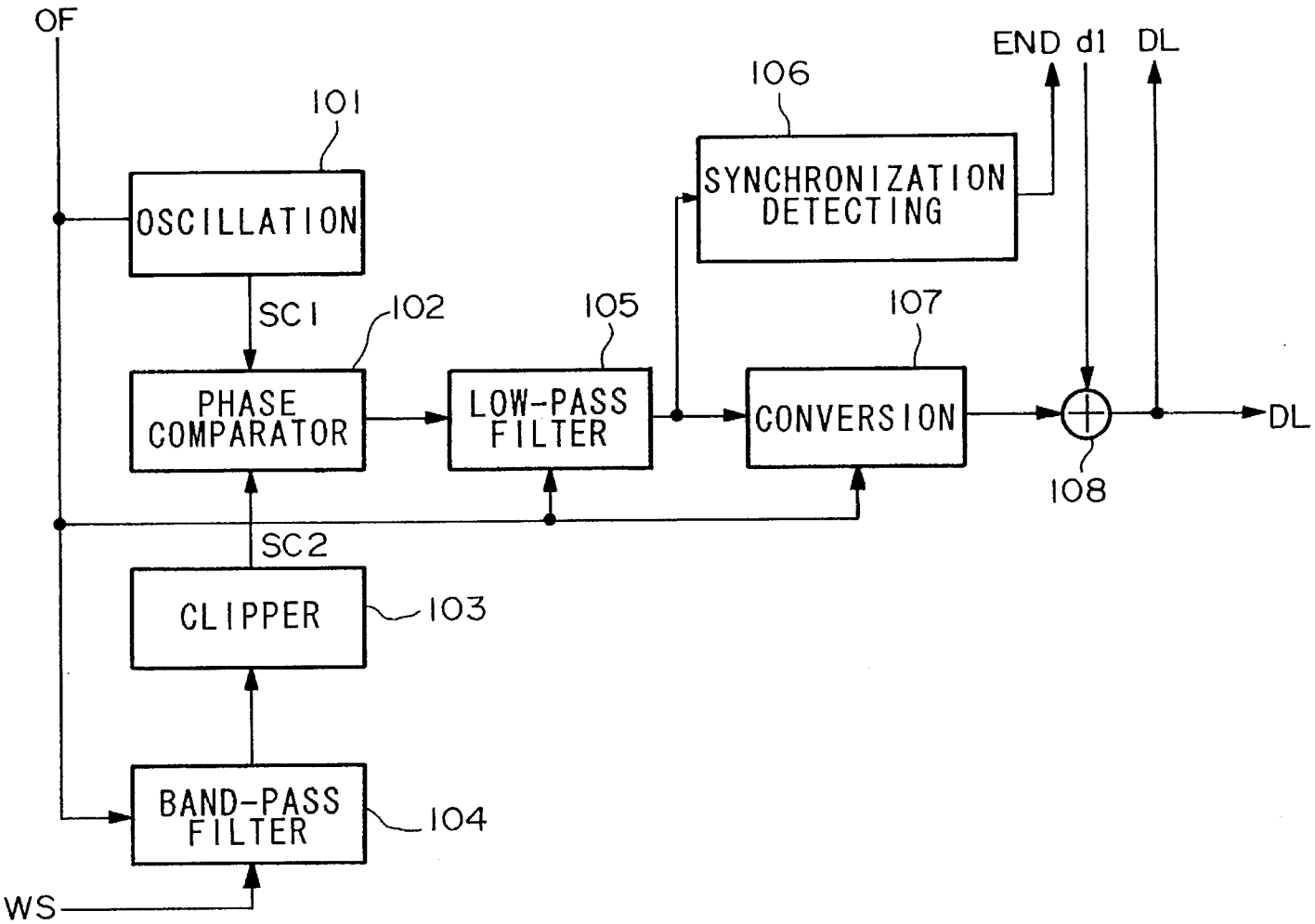
FIG.5 (PRIOR ART)
FIG. 5 is a block diagram showing the pitch adjusting portion, based on the PLL system, which is incorporated into the sound synthesis system conventionally known.

Now, operations of the sound synthesis system of FIG. 1 will be described. The tone-color forming portion 2 receives two kinds of inputs, i.e., 'input 1' and 'input 2'. Herein, the input 1 is an input signal such as an impulse signal; or the input 1 is a signal, which excites generation of a musical tone signal by the loop, such as an excitation signal DS or the blowing-pressure signal PRES. The input 2 is a signal regarding a parameter 'TCFC' or a loop-gain signal 'LOOP-GAIN' (see FIG. 2); in other words, the input 2 is a signal, which controls a signal circulating through the loop or which controls characteristic of the loop, such as the embouchure signal EMBS (see FIG. 4). When a set of the input 1 and input 2 are applied to the tone-color forming portion 2, a desired tone color is imparted to the input signal by the tone-color forming portion 2. The tone-color forming portion 2 is configured by a filter or the like. An output signal of the tone-color forming portion 2 is supplied to the interpolation filter 3 and the pitch adjusting portion 1. The interpolation filter 3 imparts a small delay to the above output signal in response to a filter constant which is supplied thereto from the pitch computing portion 12. An output signal of the interpolation filter 3 is supplied to the delay portion 4 in which it is delayed by a certain delay time which is determined responsive to a number of delay stages. The number is determined by the correction computing portion 12. Thereafter, an output signal of the delay portion 4 is fed back to the tone-color forming portion 2. Thus, the input signal circulates through the loop.

In the loop, a musical tone output is extracted from the output signal of the tone-color forming portion 2. Herein, pitch of the musical tone output is determined by a total amount of delay in the loop.

When changing the tone color formed by the tone-color forming portion 2, a filter coefficient for the filter which configures the tone-color forming portion 2 should be changed. In that case, a shift in phase characteristic (or a shift in delay characteristic) occurs in association with a change of the filter coefficient. In other words, a delay time of the tone-color forming portion 2 is changed. Thus, the pitch of the musical tone output from the loop should be shifted.

In order to avoid an undesired shift in the pitch of the musical tone output, the pitch adjusting portion 1 is provided in accordance with the present invention. Herein, the pitch adjusting portion 1 detects the pitch of the musical tone output; and then, the number of delay stages and the filter constant are controlled on the basis of result of detection in such a way that the loop can provide the musical tone output having a desired pitch.

Specifically, the pitch detecting portion 13 detects the pitch of the musical tone output from the loop so as to produce pitch data representative of result of the detection. The pitch data is supplied to the correction creating portion 14. The correction creating portion 14 receives the reference pitch data corresponding to a musical tone to be produced. The correction creating portion 14 calculates a difference between the pitch data and reference pitch data. Then, pitch-difference data representative of the difference calculated is supplied to the correction computing portion 12. In order to increase speed of convergence in correction computation performed by the correction computing portion 12, the initial constant generating portion 11 generates delay data based on the reference pitch data. The correction computing portion 12 performs the correction computation based on the delay data and pitch-difference data so as to produce 'corrected' delay data. The corrected delay data is smoothly varied in value in order to suppress oscillation and hunting of a system, for example. The corrected delay data consists of an integer part and a decimal part. The integer part is used as the number of delay stages which is set for the delay portion 4, while the decimal part is used as the filter constant which is set for the interpolation filter 3.

Therefore, the delay portion 4 performs a rough delay based on the number of delay stages, while the interpolation filter 3 performs a fine delay whose delay time is smaller than a unit time of delay corresponding to one stage of delay.

Incidentally, the interpolation filter 3 can be configured by an all-pass filter (i.e., APF). However, the all-pass filter may be disadvantageous in that a filter coefficient thereof does not vary linearly responsive to a delay time thereof. For this reason, it is preferable to employ a low-pass filter as the interpolation filter 3 because the low-pass filter is advantageous in that a filter coefficient thereof varies linearly responsive to a delay time thereof.

In addition, the pitch detecting portion 13 can be designed in such a way that a pitch period (or a period of pitch) is detected by detecting a zero-cross point. The term 'pitch period' indicates a period corresponding to the pitch; in other words, the pitch period is equal to '1/(pitch frequency)'. By the way, detection of the pitch period cannot be made with high accuracy. As a method of detecting the pitch, it is possible to employ one of methods, conventionally known, which are described by papers like "Computer Voice Processing" written by Takeshi Anjuin with one member and published by Sanho-Shuppan Kabushiki Kaisha, for example. Pages 53 to 56 of this paper describe some methods as follows:

One method describes that the pitch period is detected using self-correlation function for linear predictive residual signals. Another method describes that the pitch is identified by frequency analysis processing using FFT analyzer and the like (where 'FFT' is an abbreviation for Fast Fourier Transform).

Thus, an optimum method is selected from among the above methods in accordance with a required precision in detection of the pitch and a scale of system.

Further, the initial constant generating portion 11 stores initial constants in a table form. The initial constants are determined in advance under the consideration of pitches to be produced, the total amount of delay of the loop and the tone color. Herein, the tone color is formed by the tone-color forming portion 2 in order that the musical tones can be synthesized in certain pitches which are close to desired pitches to be produced. The tone color is required for determination of the initial constants because the delay time should be changed responsive to the tone color.

Meanwhile, the sound synthesis system of FIG. 1 may be modified in such a way that the delay time of the filter configuring the tone-color forming portion 2 is computed using the filter coefficient and then the delay time computed is set for the delay portion 4 and the interpolation filter 3. As the filter configuring the tone-color forming portion 2, it is possible to use a FIR filter (where 'FIR' is an abbreviation for Finite Impulse Response). In that case, the filter can have a linear phase characteristic, so that the delay time can be computed with ease. However, the FIR filter is complicated in configuration. Instead of the FIR filter, it is possible to use an IIR filter (where 'IIR' is an abbreviation for Infinite Impulse Response) which has a relatively simple configuration and which can provide a sharp characteristic. However, the IIR filter may be disadvantageous in that a delay characteristic thereof should be changed in association with a change in a frequency characteristic thereof. Thus, complicated computation should be required for computing the delay time.

In short, it is not realistic to compute the delay time of the filter, configuring the tone-color forming portion 2, by using the filter coefficient.

Incidentally, it is possible to fabricate the pitch adjusting portion 1 on a circuit board of a personal computer which is connected with a sound synthesis system comprising a loop. In that case, the personal computer is used to perform pitch adjustment for the sound synthesis system. Herein, the pitch adjusting portion to be fabricated on the circuit board can be replaced by a digital signal processor (i.e., DSP) which provides programs for the pitch adjustment.

Moreover, a microphone can be employed to detect pitches of musical tones produced.

Figure 2:
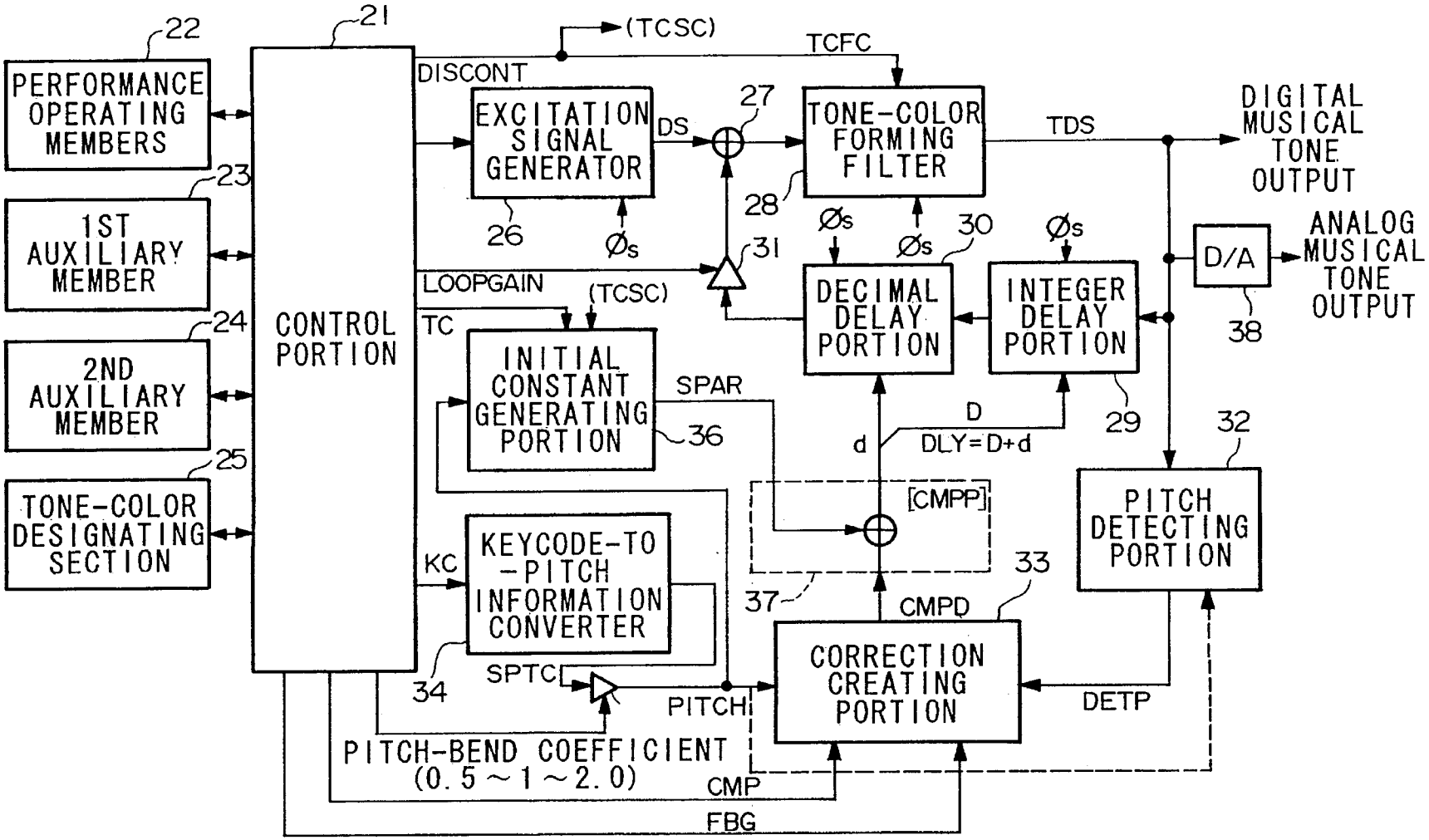
FIG. 2 is a block diagram showing a detailed configuration of the sound synthesis system.

Next, FIG. 2 shows a detailed configuration of the sound synthesis system according to the present embodiment of the present invention.

In FIG. 2, a control portion 21 comprises a central processing unit (i.e., CPU) and its peripheral circuits and the like, by which each section of the sound synthesis system is controlled. A numeral 22 denotes performance-operating members for musical performance, e.g., keys of a keyboard, wherein the performance-operating members are used to designate pitches of musical tones to be produced. First and second auxiliary members 23 and 24 are provided for assistance of the musical performance. The first auxiliary member 23 is manually operated to impart modulation effect to the musical tones. The second auxiliary member 24 (e.g., a pitch bender) is manually operated to change a pitch of a musical tone. An excitation signal generator 26 generates an excitation signal (or a drive signal) 'DS' which excites a loop for synthesizing the musical tones. An adder 27 adds the excitation signal DS to a signal circulating through the loop. A tone-color forming filter forms a tone color which is designated by a tone-color designating section 25. There are provided an integer delay portion 29 and a decimal delay portion 30, both of which are used to determine a pitch of a musical tone. Further, an amplifier 31 is provided to adjust a loop gain of the loop.

A pitch detecting portion 32 detects a pitch period of a musical tone signal outputted from the loop so as to produce detected pitch-period data 'DETP'. A correction creating portion 33, containing a low-pass filter, receives the detected pitch-period data DETP plus pitch-period data 'PITCH' which represents a designated pitch period of a musical tone to be produced. Hence, a difference between those data is outputted through the low-pass filter as delay-correction data 'CMPD'. A keycode-to-pitch-information converter 84 converts a keycode 'KC' into pitch information so as to produce reference pitch-period data 'SPTC'. A pitch-bend coefficient is set by operating the second auxiliary member 24. A multiplier 35 multiplies the reference pitch-period data SPTC by the pitch-bend coefficient so as to produce the pitch-period data PITCH. An initial constant generating portion 36 receives the pitch-period data PITCH so as to generate an initial constant 'SPAR'. A correction computing portion comprising an adder, receives the delay-correction data CMPD of the correction creating portion 83 and the initial constant SPAR of the initial constant generating portion 86. They are added together to form delay data 'DLY' which consists of an integer part 'D' and a decimal part 'd'. The integer part D is supplied to the integer delay portion 29, while the decimal part d is supplied to the decimal delay portion 80. A digital-analog converter 38 converts a digital musical tone signal, outputted from the loop, into an analog musical tone signal.

Next, operations of the sound synthesis system of FIG. 2 will be described in detail. When operating the tone-color designating section 25 and the first auxiliary member 23, the control portion 21 creates an excitation-waveform control signal 'DSCONT', which is then supplied to the excitation signal generator 26. The excitation signal generator 26 generates a loop-excitation signal 'DS' corresponding to an excitation waveform designated. The loop-excitation signal DS is supplied to the tone-color forming filter 28 through an adder 27. The tone-color forming filter 28 receives a value (or values) of a fundamental parameter 'TCFC' which is determined responsive to an operation to the tone-color designating section 25. The parameter TCFC is varied in value in response to operations to the performance-operating members 22 and/or the first auxiliary member 23; and consequently, a filter characteristic of the tone-color forming filter 28 is varied.

The tone-color forming filter 28 imparts a certain tone color to the loop-excitation signal DS so as to produce a loop-excitation signal 'TDS', which is then supplied to both of the integer delay portion 29 and the pitch detecting portion 32. The integer part D represents an integral number within a total number of delay stages which is represented by the delay data DLY. Thus, the integer delay portion 29 delays the loop-excitation signal TDS by a delay time corresponding to the integral number of delay stages. Then, an output signal of the integer delay portion 29 is supplied to the decimal delay portion 30. The decimal part d represents a decimal number of delay stage whose delay time is smaller than one stage of delay. The decimal delay portion 30 delays the output signal of the integer delay portion 29 by a delay time corresponding to the decimal part d. Thus, a delayed loop-excitation signal is outputted from the decimal delay portion 30 and is then amplified by the amplifier 31. Gain of the amplifier 31 is adjusted by a loop-gain signal 'LOOP-GAIN'. An output signal of the amplifier 31 is supplied to the adder 27 in which it is added to the loop-excitation signal DS. Thus, the loop-excitation signal circulates through the loop. Incidentally, a digital musical tone output is extracted from the tone-color forming filter 28.

The pitch detecting portion 32 employs one of The aforementioned methods, by which the pitch period is detected. Thus, the detected pitch-period data DETP is supplied to the correction creating portion 33. The correction creating portion 33 receives the pitch-period data PITCH which is produced, based on the fundamental pitch-period data SPTC and the pitch-bend coefficient, by the multiplier 35. A difference between the detected pitch-period data DETP and The pitch-period data PITCH is calculated by the correction creating portion 33. The difference calculated passes through The low-pass filter so that it is processed to be varied smoothly. Thus, the delay-correction data CMPD is outputted from the correction creating portion 33 and is then supplied To the correction computing portion 37. A filter coefficient 'CMP', used for the low-pass filter, and a feedback gain signal 'FBG' are supplied to The correction creating portion 33 from the control portion 21. The feedback gain signal FBG is provided To determine a loop gain of a delay-control loop including the pitch detecting portion 32 and The correction creating portion 33. As The feedback gain signal FBG becomes larger, an amount of correction becomes larger. The elements CMP and FBG are respectively set at certain values, wherein those values are determined in such a way that stability of the system is not damaged. In other words, optimum values are selected for them under the consideration of the tone color or configuration of the loop.

By adjusting the filter coefficient CMP and the feedback gain signal FBG, it is possible to intentionally impart unstable fluctuations to musical tones.

The keycode KC corresponds to the performance-operating member 22 (e.g., key) which is manually operated. The keycode KC is supplied to the keycode-to-pitch-information converter 34 in which it is converted into the reference pitch-period data SPTC. The multiplier 35 multiplies the reference pitch-period data SPTC by the pitch-bend coefficient which is set responsive to a manual operation to the second auxiliary member 24. Thus, the reference pitch-period data SPTC is varied in such a way that a desired variation occurs in pitch of the musical tone output in response to the manual operation of the second auxiliary member 24. The pitch-period data PITCH, outputted from the multiplier 35, is supplied to the correction creating portion 33 as well as the initial constant generating portion 36. The initial constant generating portion 36 receives a tone-color designating signal 'TC' representative of a tone color designated by the tone-color designating section 25. The tone-color designating signal TC is used to refer to a table, by which a delay time of the tone-color forming filter 28 is roughly acknowledged. Thus, the initial constant generating portion 36 produces the reference pitch-period data SPAR which is set in such a way that the total amount of delay of the loop becomes roughly equivalent to the pitch-period data PITCH.

The correction computing portion 37 adds the reference pitch-period data SPAR to the delay-correction data CMPD so as to produce the delay data DLY consisting of the integer part D and the decimal part d. The integer part D is supplied to the integer delay portion 29, while the decimal part is supplied to the decimal delay portion 30.

Incidentally, it is possible to supply the aforementioned parameter TCSC to the initial constant generating portion 36, wherein the parameter TCSC has been used to determine the filter characteristic of the tone-color forming filter 28. In that case, the reference pitch-period data DPAR can be produced under the consideration of the parameter TCSC as well.

At an initial state of the sound synthesis system, the delay-correction data CMPD has not been produced yet. Therefore, a pitch of a musical tone output initially synthesized by the loop is set in accordance with the reference pitch-period data SPAR, outputted from the initial constant generating portion 36, and the delay time of the tone-color forming filter 28. If a pitch period of the musical tone output initially synthesized is shifted from the pitch-period data PITCH, a shift in pitch period is detected by the pitch detecting portion 32 so that the detected pitch-period data DETP is produced. Then, a difference between the detected pitch-period data DETP and the pitch-period data PITCH is calculated by the correction creating portion 33 so that the delay-correction data CMPD is produced. The delay-correction data CMPD is supplied to the correction computing portion 37; and consequently, an amount of delay of the integer delay portion 29 and an amount of delay of the decimal delay portion 30 are corrected. As a result, the pitch period of the musical tone output from the tone-color forming filter 28 will be controlled to coincide with the pitch-period data PITCH.

As described heretofore, the present embodiment is designed to perform the pitch adjustment while monitoring pitches of musical tones in real time. Thus, as compared to the conventional technology, the present embodiment is advantageous in that the pitch adjustment can be performed at high speed and with accuracy.

In FIG. 2, a symbol 'øs' represents sampling clocks. Thus, some portions of the sound synthesis system of FIG. 2 operate responsive to timings of the sampling clocks.

Next, a detailed configuration of the correction creating portion 33 will be described with reference to FIG. 3A.

Figure 3A:
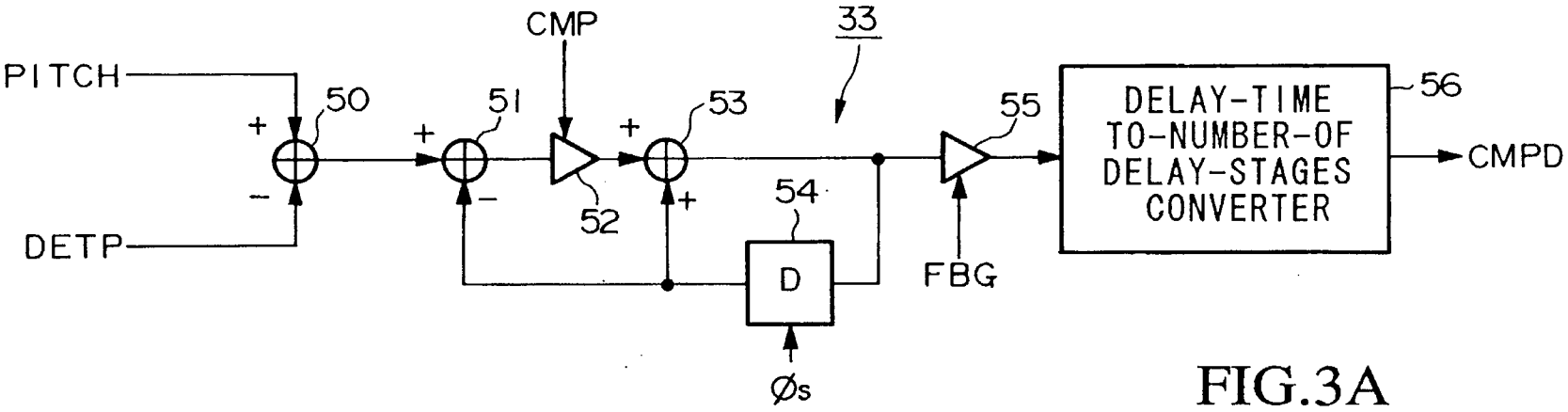
FIGS. 3A is a block diagram showing an internal configuration of a correction creating portion shown in FIG. 2.

In the correction creating portion 33 shown in FIG. 3A, a subtracter 50 subtracts the detected pitch-period data DETP from the pitch-period data PITCH so as to calculate difference data. The difference data is supplied to a low-pass filter which is configured by a subtracter 51, a multiplier 52, an adder 53 and a delay element 54. Output data of the low-pass filter is delayed by the delay element 54 and is then fed back to the subtracter 51 and the adder 53. Cut-off frequency of the low-pass filter is determined by the filter coefficient CMP which is supplied to the multiplier 52.

The output data of the low-pass filter is supplied to a multiplier 55 in which it is multiplied by the feedback gain data FBG. Result of multiplication of the multiplier 55 is supplied to a delay-time-to-number-of-delay-stages converter 56 as delay-time data. The delay-time data is divided by a unit delay time corresponding to one stage of delay of the integer delay portion 29. Or a conversion table is referred to using the delay-time data. Thus, the delay-time data is converted into the delay-correction data CMPD, representative of a number of delay stages, consisting of the integer part D and the decimal part d.

Incidentally, optimum values are selected for the filter coefficient CMP and the feedback gain data FBG in such a way that stability of the system is obtained. In other words, the optimum values are selected under the consideration of the tone color or configuration of the loop.

If the difference data is relatively large, the cut-off frequency of the low-pass filter can be increased in order to secure high-speed processing. However, if the difference data is so large that the oscillation or hunting occurs in the system, the cut-off frequency should be adequately selected in response to amount of the difference data.

The integer delay portion 29 is configured by a shift register or a random-access memory (i.e., RAM). On the other hand, the decimal delay portion 30 can be configured by an all-pass filter; or a configuration of FIG. 3B can be employed for the decimal delay portion 30.

Next, the configuration of FIG. 3B will be described. A loop signal, which is outputted from the integer delay portion 29, is supplied to the decimal delay portion 30. The loop signal is supplied to a first multiplier 61 through a delay element 60 whose delay time corresponds to one stage of delay; and then, result of multiplication of the first multiplier 61 is supplied to an adder 62. In addition, the loop signal is directly supplied to a second multiplier 63 whose result of multiplication is supplied to the adder 62. The first multiplier 61 receives the decimal part d of the delay data DLY as a coefficient thereof. The decimal part d is inverted by a third multiplier 64. Then, an inverted decimal part '−d' is added to a digit '+1' by an adder 65. Thus, result of addition of the adder 65 is set at '1−d'. A value of '1−d' is supplied to the second multiplier 63 as its coefficient.

Figure 3B:
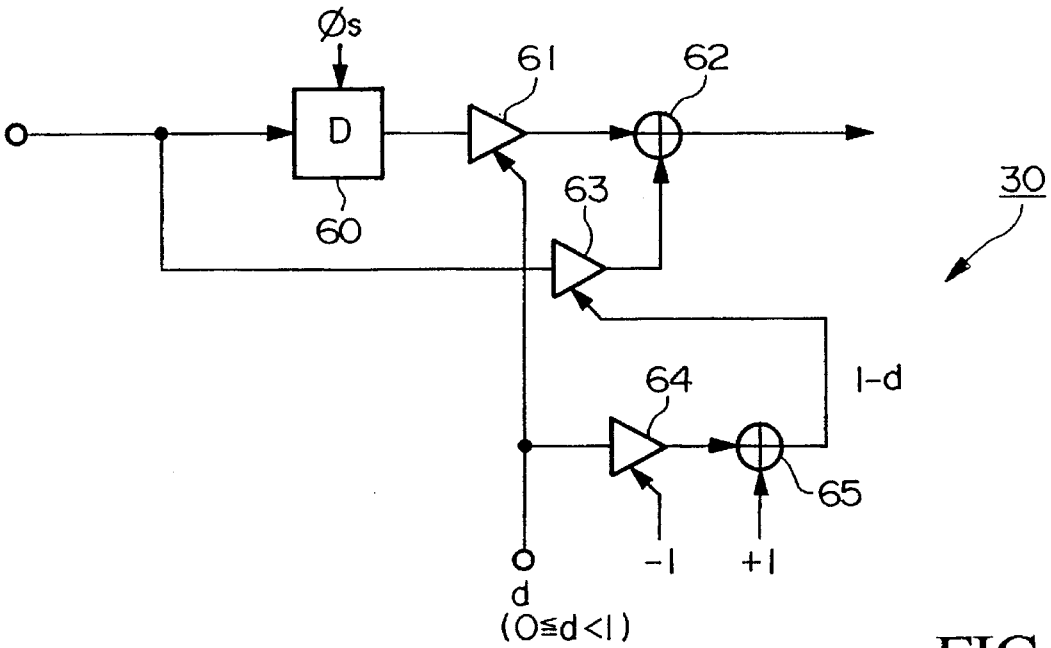
FIG. 3B is a block diagram showing an internal configuration of a decimal delay portion shown in FIG. 2.

The loop signal, applied to the decimal delay portion 30 of FIG. 3B, is subjected to one stage of delay by the delay element 60; and then, the loop signal delayed is supplied to the first multiplier 61 in which it is adjusted in level by the coefficient 'd'. On the other hand, the loop signal is supplied to the second multiplier 63 in which it is adjusted in level by the coefficient '1−d'. Results of multiplication of the multipliers 61 and 63 are added together by the adder 62.. Thus, result of addition of the adder 62 indicates a signal which is delayed behind the loop signal by less than one stage of delay.

The initial constant generating portion 36 is configured by a data table which is accessed using pitch designating information, i.e., pitch-period data PITCH. Instead of the data table, it is possible to employ computation processing by which the reference pitch-period data SPAR is computed based on the pitch designating information.

Further, the aforementioned tone-color forming filter 28 can be replaced by a non-linear table or non-linear computation which executes deformation processing on waveforms and the like.

Furthermore, all of the tone-color forming portion 28, the integral delay portion 29 and the decimal delay portion 30 can be replaced by a filter device or the like which can provide a desired delay, which is determined responsive to the pitch, as well as a desired frequency characteristic.

The sound synthesis system can be configured by using hardware elements, computer systems, DSP, electronic circuits or the like. When using the DSP as disclosed by the U.S. Pat. No. 5,212,334, it is designed to execute programs realizing functions of the sound synthesis system. When using the electronic circuits, they are designed to perform tone-generation algorithms corresponding to the sound synthesis system. Or the sound synthesis system can be configured by a hybrid system which is made by combining the above elements and the like.

Moreover, the sound synthesis system of FIG. 2 can be re-designed in such a way that the excitation signal generator 26 and the loop are incorporated in a musical tone synthesizing device, while remaining portions are assembled together to form a pitch adjusting device. In that case, the pitch adjusting device is connected with the musical tone synthesizing device and is used to perform a pitch adjustment.

The pitch adjustment can be performed by real-time processing. Instead, it is possible to store various amounts of correction in a correction creating portion in advance, wherein the various amounts of correction have been created by performing pitch-correction processing under the consideration of possible variations of parameters. In that case, the pitch adjustment is performed using an appropriate amount of correction which is read from the correction creating portion in a performance mode.

Incidentally, the sound synthesis system of FIG. 2 can be re-designed in such a way that a correction is made directly on the pitch-period data PITCH. In that case, the initial constant generating portion 36 can be canceled. In addition, the keycode-to-pitch-information converter 34 is modified such that it produces pitch information, which corresponds to the initial constant, in response to the tone-color information TC.

In addition, the excitation signal generator 26 can be configured by a memory from which an excitation waveform is read out on demand; it can be designed using a certain modulation technique, e.g., frequency modulation or amplitude modulation; it can be configured by a noise generator or a pulse generator; and it can be configured in such a way that an excitation signal is generated responsive to a detection signal of a sensor such as an impulse sensor.

As this invention may be embodied in several forms without departing from the spirit of essential characteristics thereof, the present embodiment is therefore illustrative and not restrictive, since the scope of the invention is defined by the appended claims rather than by the description preceeding them, and all changes that fall within meets and bounds of the claims, or equivalence of such meets and bounds are therefore intended to be embraced by the claims.

What is claimed is:

1. A sound synthesis system having a pitch adjusting function, comprising:

loop means, containing delay means, through which a sound signal circulates;

pitch detecting means for detecting a pitch of the sound signal, which is extracted from the loop means, so as to produce first pitch information representative of the pitch detected;

pitch designating means for designating a pitch for a sound to be produced so as to produce second pitch information representative of the pitch designated;

initial constant creating means for creating an initial constant, corresponding to an initial delay, in accordance with the second pitch information, the initial delay being applied to the delay means so that the sound signal, circulating through the loop means, is subjected to the initial delay by the delay means; and correcting means for correcting an amount of delay of the delay means in such a way that the pitch of the sound signal is automatically adjusted to be equal to the pitch represented by the second pitch information in real time.

2. A sound synthesis system according to claim 1 wherein the initial constant creating means creates the initial constant in accordance with a tone color or a configuration of the loop means.

3. A sound synthesis system according to claim 1 wherein the initial constant creating means is configured by a table storing a variety of initial constants so that an optimum initial constant is selected by referring to the table in accordance with the second pitch information.

4. A sound synthesis system according to claim 1 wherein the correcting means calculates an amount of correction based on a difference between the first pitch information and the second pitch information, so that the amount of delay of the delay means is corrected using the amount of correction.

5. A pitch adjusting device which adjusts pitches of sounds synthesized by a sound synthesis system comprising loop means containing delay means, the pitch adjusting device comprising:

pitch detecting means for detecting a pitch of a sound signal, which circulates through the loop means, so as to produce first pitch information representative of the pitch detected;

pitch designating means for designating a pitch for a sound to be produced so as to produce second pitch information representative of the pitch designated;

initial constant creating means for creating an initial constant, corresponding to an initial delay, in accordance with the second pitch information, the initial delay being applied to the delay means so that the sound signal, circulating through the loop means, is subjected to the initial delay by the delay means; and correcting means for correcting an amount of delay of the delay means in such a way that the pitch of the sound signal is automatically adjusted to be equal to the pitch represented by the second pitch information in real time.

6. A sound synthesis system having a pitch adjusting function, comprising:

excitation signal generating means for generating an excitation signal;

pitch designating means for designating a pitch for a sound to be produced;

tone-color designating means for designating a tone color for the sound;

loop means through which the excitation signal circulates, the loop means comprising at least filter means and delay means, the filter means imparting a tone-color characteristic, corresponding to the tone color designated, to the excitation signal so as to produce a sound signal, the delay means imparting an amount of delay to the sound signal;

pitch detecting means for detecting a pitch of the sound signal outputted from the filter means;

initial constant generating means for generating an initial constant based on the pitch designated and/or the tone color designated, the initial constant representing an initial delay which is effected by the delay means;

correction creating means for creating an amount of correction based on a difference between the pitch designated and the pitch detected; and correcting means for correcting the amount of delay of the delay means by using the amount of correction in such a way that the pitch of the sound signal is automatically adjusted to be equal to the pitch designated in real time.

7. A sound synthesis system according to claim 6 wherein the delay means comprises integer delay means and decimal delay means, the integer delay means having a first delay time which corresponds to a number of delay stages each corresponding to a unit time of delay determined in advance, while the decimal delay means has a second delay time which is smaller than the unit time of delay.

8. A sound synthesis method comprising the steps of:

detecting a pitch of a sound signal, which circulates through a loop containing a delay, so as to produce first pitch information representative of the pitch detected;

designating a pitch for a sound to be produced so as to produce second pitch information representative of the pitch designated;

creating an initial constant, corresponding to an initial delay, in accordance with the second pitch information;

imparting the initial delay to the sound signal circulating through the loop; and correcting an amount of delay, imparted to the sound signal, in such a way that the pitch of the sound signal is automatically adjusted to be equal to the pitch represented by the second pitch information in real time.

* * * * *